US005738291A

United States Patent [19]

Tholander

[11] Patent Number: 5,738,291

[45] Date of Patent: Apr. 14, 1998

[54] YARN BRAKING DEVICE AND YARN STORAGE AND FEED DEVICE

[75] Inventor: Lars Helge Gottfrid Tholander, Ulricehamn, Sweden

[73] Assignee: IRO AB, Ulricehamn, Sweden

[21] Appl. No.: 704,527

[22] PCT Filed: Mar. 9, 1995

[86] PCT No.: PCT/EP95/00880

§ 371 Date: Nov. 4, 1996

§ 102(e) Date: Nov. 4, 1996

[87] PCT Pub. No.: WO95/24355

PCT Pub. Date: Sep. 14, 1995

[30] Foreign Application Priority Data

Mar. 9, 1994 [DE] Germany ..... 44 07 958.3

[51] Int. Cl.[6] ..... B65H 51/00; D03D 47/36

[52] U.S. Cl. ..... 242/47.01; 139/452; 242/364

[58] Field of Search ..... 242/47.01, 128, 242/364, 419.4; 139/452

[56] References Cited

U.S. PATENT DOCUMENTS

| | | | |
|---|---|---|---|
| 3,926,381 | 12/1975 | Lawson et al. | 242/47.01 |
| 4,161,297 | 7/1979 | Vella | 139/452 X |
| 4,429,723 | 2/1984 | Maroino | 242/47.01 X |
| 4,452,402 | 6/1984 | Ghiardo | 242/47.01 |
| 5,310,127 | 5/1994 | Deiuri | 242/47.01 |
| 5,316,051 | 5/1994 | Zenoni et al. | 242/47.01 X |
| 5,546,994 | 8/1996 | Sarfati | 242/47.01 X |
| 5,553,641 | 9/1996 | Zenoni | 242/47.01 X |

FOREIGN PATENT DOCUMENTS

| | | | |
|---|---|---|---|
| 0 049 897 A1 | 4/1982 | European Pat. Off. . | |
| 197 808 | 8/1978 | Germany | 242/47.01 |
| 94/20402 | 9/1994 | WIPO | 242/47.01 |
| WO 95/00431 | 1/1995 | WIPO . | |

*Primary Examiner*—Michael Mansen

*Attorney, Agent, or Firm*—Flynn, Thiel, Boutell & Tanis, P.C.

[57] ABSTRACT

A yarn braking device includes a resilient annular braking element having provided therein a circumferentially extending braking surface. The braking surface is adapted to be moved into contact with a circular draw-off area of a yarn storage drum under the influence of an axial biasing force. The yarn braking device also includes an annular carrier provided on the braking element, and a stationary Cardan holding device used for supporting the braking element which is movably supported via first and second Cardan axes, and for applying the biasing force thereto. The second Cardan axis is formed of pairs of contact areas provided on the annular carrier on the one hand and on a support ring on the other. The pairs of contact areas are adapted to be detached from one another and to be pressed onto one another by means of the biasing force wherein the support ring is supported in the Cardan holding device such that it is tiltable about the first Cardan axis.

27 Claims, 2 Drawing Sheets

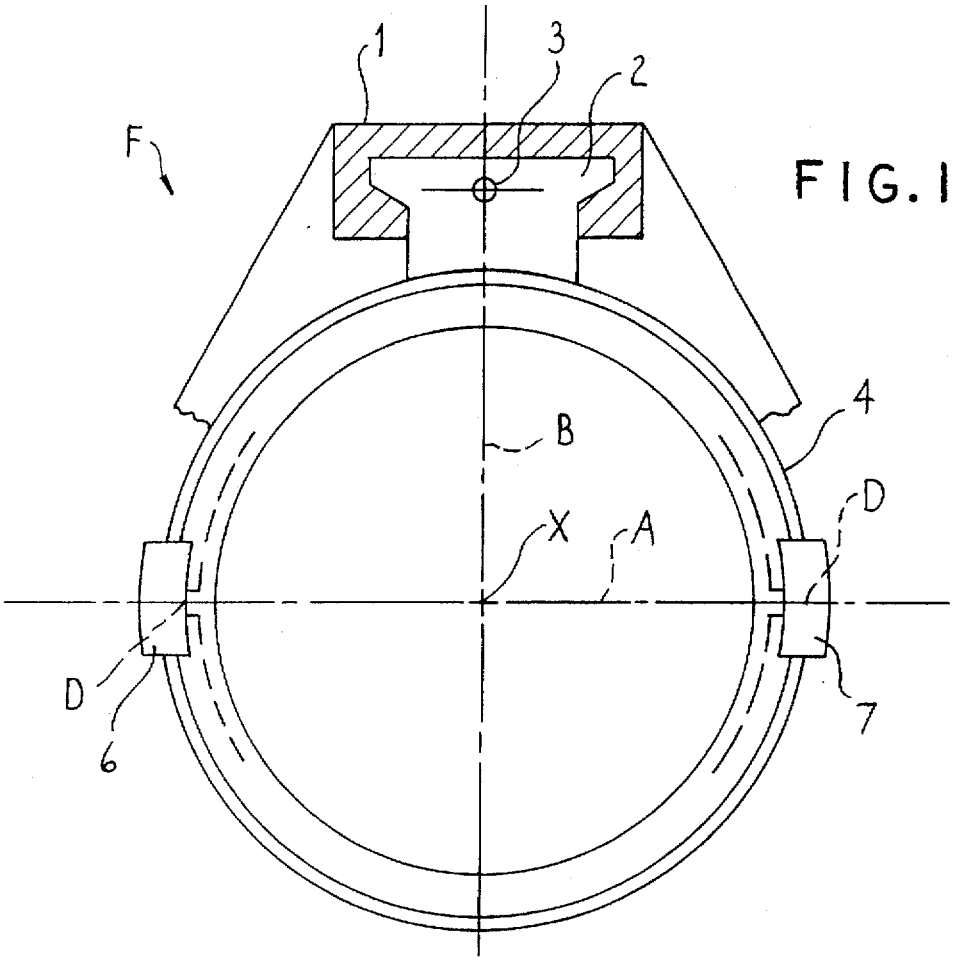
FIG. 1
FIG. 6A
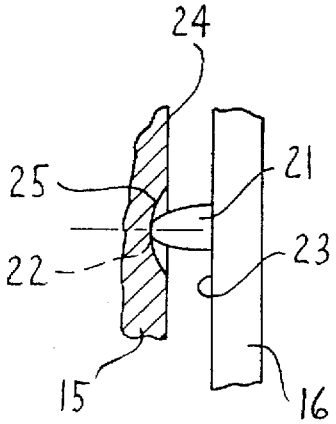
FIG. 6B
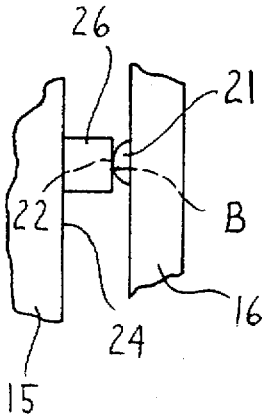

F
X
9
V
1
T
E
10
14
5
18
4
17
K
15
19
6
20
16
12
13
11
21
22
B
24
7
A
20
A
12
21
22
B
16
15
20
13
12
15
14
21
16
20
21
23

YARN BRAKING DEVICE AND YARN STORAGE AND FEED DEVICE

FIELD OF THE INVENTION

The present invention refers to a yarn braking device having a Cardan holding device supporting a braking element which biases the braking element in contact with a storage drum by a biasing force and defines first and second Cardan axes.

DESCRIPTION OF THE RELATED ART

In a yarn braking device which is known because it has been used in practice (IT-MI 93A001313 having a prior time rank), the braking element is an annular rubber membrane having fixed thereto a frustoconical metal surface as a braking surface and including at least one circumferential corrugation in the wall of the membrane. Two diametrically arranged pins engage the annular carrier from outside, said pins being arranged in end areas of a supporting fork and defining the second Cardan axis. The base member of the fork is adapted to be rotated about the first Cardan axis in a stationary slide. The biasing force with which the braking surface abuts on the draw-off area of the yarn storage drum is adjusted by axially displacing the slide. The braking element is capable of carrying out balancing movements in the Cardan holding device. As a result of these balancing movements, a self-centering effect of the braking surface and a self-adjusting effect of said braking surface with regard to a circumferentially uniform contact force are achieved.

A similar Cardan holding device for a lamellar braking element is known from EP-O 049 897 A1. The lamellar braking element is held in a cage-like annular carrier on the outer side of which two pins are arranged which define the second Cardan axis, The pins are supported in prongs of a forkshaped body, which is adapted to be tilted about the first Cardan axis in a stationary slide.

In both known solutions, the Cardan holding device comprises a comparatively large amount of components and this makes it more difficult to mount and dismount the braking element. This difficulty is also due to the fact that the braking element is so to speak an integrated part of the Cardan holding device. In addition the Cardan axes extend at a large axial distance from one another, and this may impede smooth adjustment or centering of the braking surface.

It is the object of the present invention to provide a yarn braking device of the type mentioned herein, which is provided with a structurally very simple and compact Cardan holding device that is easy to mount, and a yarn storage and feed device. In accordance with a further aspect of the present invention, better centering of the braking element is to be achieved and the adaptive adjustment of said braking element is to be facilitated.

SUMMARY OF THE INVENTION

The Cardan holding device of the invention can be produced easily and at a moderate price. The braking element is easy to mount because it is only loosely received in the Cardan holding device and because it is only the biasing force that couples said braking element functionally to the Cardan holding device in the second Cardan axis. The annular carrier and the support ring can easily be installed in the Cardan holding device one after the other. The second Cardan axis is so to speak first imaginary and it is only the cooperation between the support ring and the annular carrier under the influence of the biasing force by means of which said second Cardan axis is structurally realized. The braking element can be replaced by a different type of braking element including an appropriate annular carrier at any time. Under certain circumstances, the braking element needs no structural preparation for a cooperation with the Cardan holding device at all, since said Cardan holding device itself has all the preconditions required for the Cardan function. By means of the loose arrangement of the annular carrier, an additional advantage is achieved since the annular carrier is provided with an additional degree of freedom in relation to the Cardan axes because the annular carrier can moved at least to a limited extent, relative to the two Cardan axes in the radial direction. The braking element chooses so to speak automatically the appropriate position relative to the Cardan axes supported in the Cardan holding device. In addition, it is adapted to be rotated about its longitudinal axis relative to the two Cardan axes. The Cardan axes extend at an advantageously short distance from one another, and this guarantees a smooth adjustment and centering of the braking surface.

This simple support principle, which permits an advantageous mounting mode, can be used universally for all generally used yarn braking devices, e.g. for so called lamellar or brush brakes, having an annular carrier which is tiltably supported on the support ring only under the influence of the axial biasing force required for the yarn braking function. The annular carrier therefore is tiltable about the second Cardan axis which is, in principle, an open Cardan axis. The support ring is, in turn, supported in the holding device such that it is tiltable about the first Cardan axis.

The yarn storage and feed device wherein the annular carrier is loosely supported on the support ring is characterized by a good self-centering effect of the annular carrier in the Cardan holding device, by simple handling during the assembly and disassembly of the braking element, by the fact that the braking element can be exchanged at any time and by compact dimensions of the Cardan holding device. These advantages are provided irrespectively of whether the braking element has a continuous or a discontinuous braking surface which cooperates with the draw-off area of the storage drum so as to slow down the yarn that circles the draw-off area while being drawn off the storage drum.

The yarn braking device wherein the second Cardan axis is defined by pairs of contact areas between the annular carrier and the support ring is additionally characterized by the fact that the braking element consisting of a rubber material or of a rubber-like material includes a structurally integrated spring and, in addition, a structurally integrated balloon control element due to at least one circumferentially extending corrugation, which is concentric with the longitudinal axis of said braking element, and due to the nature of the material used for said braking element. The corrugation extends in a direction opposite to the withdrawal direction of the yarn running towards the braking surface and creates an obstacle for the yarn. Otherwise the yarn, during the unwinding operation, has a tendency to lift off radially from the storage drum while travelling from the yarn windings on the storage drum to the braking zone between the braking surface and the draw-off edge of the storage drum (i.e., ballooning). The corrugation has a balloon-breaking or a balloon-reducing effect. The integrated spring transmits, on the one hand, the axial biasing force to the braking surface and permits, on the other hand, local deformation movements of the braking surface as well as centering and adaptation movements of said braking surface in relation to the annular carrier of the braking element. These features of the braking element, which produce a combinatorial effect, are realized in an ideal manner in one and the same component, viz. the braking element itself, by the material chosen, by the shape and by the structural design of the cross-section.

By means of the structural design wherein the contact areas on one of the annular carrier and support ring are defined by axial projections, a compact structural design is achieved. Assembly and disassembly can be carried out easily and rapidly. The annular carrier is coupled with the support ring in the second Cardan axis only in the peak contact points and this coupling only takes place under the influence of the biasing force of the braking element. The braking element is in this way supported in a stable manner, but still movable in all directions, because the force-transmitting contact points are located at large distances from the centre.

If necessary, a light positive engagement between the annular carrier and the support ring can be provided where the protrusion seats in a depression or contacts a projection.

Forming the support ring and annular carrier of the same size and making the protrusions semi-cylindrical contribute to a compact structural design and the ease of manufacture.

The embodiment where the support ring is supported by rotary bearings is structurally simple because the Cardan holding device only needs the rotary bearings for the first Cardan axis. Two rotary bearings result in a stable support of the support ring at a large distance from the longitudinal axis of said support ring.

An embodiment which is easy to assemble and easy to produce includes a slide to which the rotary bearings are mounted. Only the annular holder is part of the slide. The rotary bearings, by means of which the support ring is tiltably supported, are releasably secured to the holder, and this is advantageous for assembly and disassembly operations. In view of the fact that the holder encloses the annular carrier with a certain amount of play, the annular carrier is able to carry out the movements which are necessary for centering said annular carrier and for adjusting it.

On the basis of the embodiment where the bearing blocks include inner reception means for the holder and the bearing block mounts to the annular holder by a fastening element, the bearing blocks are fixedly secured to the holder and can easily be demounted.

On the basis of the embodiment where the bearing block has a radial hole which receives the engagement element therein, smoothly and precisely operating rotary bearings for the support ring can be formed. The engagement elements on the support ring are easy to produce.

A particularly expedient embodiment is the embodiment where the projections abut against an opposing flat surface of the annular carrier. The flat ring side of the annular carrier permits mounting of the braking element at any rotary position and it permits an automatic radial adjustment of the braking element at an optimum position because the force-transmitting contacts in the second Cardan axis are only established under the influence of the biasing force. Arbitrary types of braking elements can selectively be secured in position in the Cardan holding device, provided that the annular carrier has a size that is compatible with the projections on the support ring.

BRIEF DESCRIPTION OF THE DRAWINGS

Embodiments of the subject matter of the invention are explained on the basis of the drawings, in which:

FIG. 1. shows a front view of a Cardan holding device of a yarn storage and feed device, FIG. 6A shows a variation of the invention, and FIG. 6B shows another variation of the invention.

DETAILED DESCRIPTION

Figures 2, 3, 4, 5:
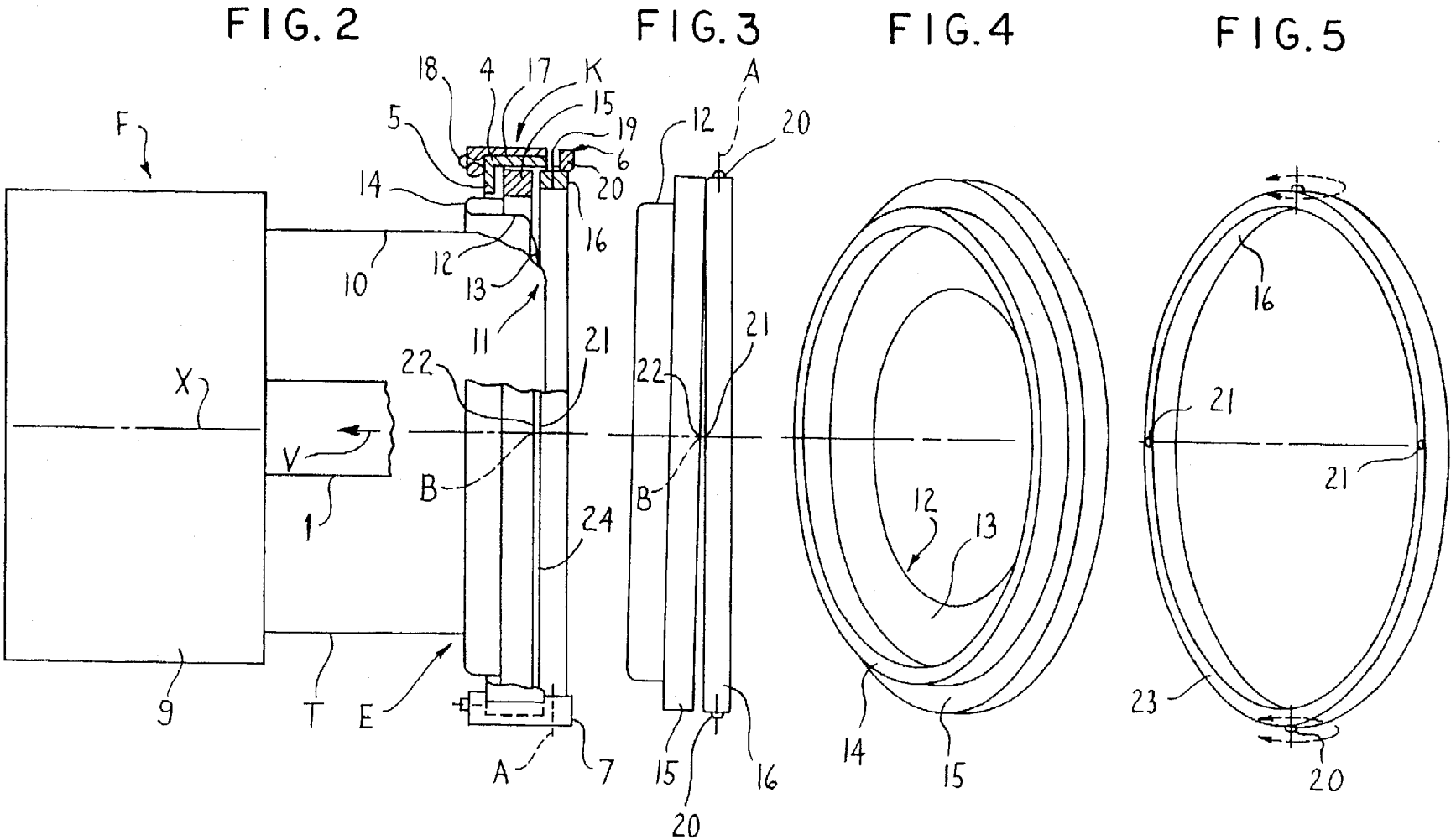
FIG. 2 shows a top view of FIG. 1, part of said FIG. 2 being a sectional view.
FIG. 3 shows a side view of a detail of FIG. 2.
FIG. 4 shows a perspective side view of a braking element that is adapted to be used in FIG. 2.
FIG. 5 shows a perspective side view of a detail of FIGS. 2 and 3.

FIGS. 1 and 2 show a schematic representation of a yarn storage and feed device F, FIG. 1 being a front view in the direction of the longitudinal axis X from the right-hand side in FIG. 2. In FIG. 1, a support bracket 1 of the yarn storage and feed device F can be seen, a slide 2 being held and guided in said support bracket 1 such that it is adapted to be displaced parallel to the longitudinal axis X e.g. by means of an adjusting screw 3. The slide 2 is part of a Cardan holding device K, which is provided for supporting a yarn braking device E shown in FIG. 2. The slide 2 has arranged thereon an annular holder 4, which is formed integrally with said slide 2 in an expedient manner and which is provided with an internal flange 5. Two diametrically opposed bearing blocks 6, 7 are secured in position on said holder 4, said bearing blocks 6, 7 defining rotary bearings D for a support ring 16 outlined by a broken line. The support ring 16 is adapted to be tilted about a first Cardan axis A in the rotary bearings D of the bearing blocks 6, 7 and it is encompassed by the holder 4 with a certain amount of play. The Cardan holding device K has a second Cardan axis B, which extends approximately at right angles to the first Cardan axis A and which is located behind the first Cardan axis A at a small distance therefrom in FIG. 1.

The yarn storage and feed device F has a housing 9, a yarn storage drum T, which is coaxial with the longitudinal axis X, being supported on said housing 9 in a stationary manner. The yarn storage drum T has a peripheral storage surface 10 and a circular draw-off area 11 in which the yarn storage drum T has an expediently rounded or conical shape.

The embodiment of the yarn braking device E shown according to FIGS. 2, 3 and 4 includes an annular braking element 12 of elastic material, such as rubber or a rubber-like elastomer, said braking element 12 being a rubber membrane having close to its inner periphery a circumferentially continuous braking surface 13 in the form of a frustoconical surface. The braking surface 13 can be a frustoconical surface consisting of a strip, e.g. a metal strip, that is fixed to the braking element 12 or integrated therein in some other manner. The braking surface 13 is moved into contact with the draw-off area 11 by means of an axial biasing force V chosen through the adjustment of the slide 2, whereupon the braking element 12 deforms. The, braking element 12 has formed therein a circumferentially extending corrugation 14 which encloses the storage surface 10 at a short distance from the outer surface thereof and which faces the housing 9. The nature of the material used for the braking element 12 and the corrugation 14 integrated therein define a spring that is integrated in the braking element 12. The corrugation 14 additionally defines a balloon control element of the yarn braking device E.

In the area of its outer periphery, the braking element 12 is connected to a dimensionally stable annular carrier 15, consisting e.g. of plastic materials which is loosely received within the holder 4 with a certain amount of axial and radial play. The support ring 16 is fixed to the holder 4 such that it is adapted to be tilted about the first Cardan axis A, said support ring 16 being located adjacent the ring side 24 of the annular carrier 15 facing away from the housing 9. For holding the support ring 16, the bearing blocks 6, 7 are fixed in position on the holder 4 by means of fastening elements 18, which may consist of tightening screws in an expedient manner. Each bearing block 6, 7 contains inner reception means 17 into which the holder 4 fits.

Inwardly open recesses 19 of the bearing blocks 6, 7, which may consist of radial holes in an expedient manner, accommodate projections 20, which may have a wart-like shape in an expedient manner and which are arranged on diametrically opposed positions on the outer periphery of the support ring 16.

The ring side 23 of the support ring 16 facing the ring side 24 has formed thereon protrusions 21 having a wart-like shape, said protrusions 21 being displaced by 90° relative to said projections 20. The annular carrier 15 is tiltably pressed via peak contact points 22 onto the peaks of said wart-like protrusions 21 under the biasing force V. In this way, the second Cardan axis B is defined under the biasing force V. The protrusions 21 may extend diametrically and they may have a semi-cylindrical structural design so that contact lines with the ring surface 24 would be obtained.

The braking element 12 with its annular carrier 15 is adapted to be tilted about both Cardan axes A, B relative to the holder 4 and the bearing blocks 6, 7 so as to achieve a self-centering and self-adjusting uniform contact between the braking surface 13 and the draw-off edge 11.

The projections 20 may be pins engaging the recesses 19. Furthermore, it is imaginable to form on the bearing blocks 6, 7 projections or pins which inwardly engage complementary recesses in the support ring 16.

In FIG. 3, it is outlined to what extent the braking element 12 can be tilted about the second Cardan axis B relative to the support ring 16. In addition, tilting movements about the first Cardan axis A are possible as well; these tilting movements tilt the support ring 16.

If the braking element 12 is to be exchanged, the fastening elements 18 will have to be released and the bearing blocks removed from the holder 4. The support ring 16 is free and can be removed to the right-hand side in FIG. 2 prior to drawing out the braking element 12.

When the braking element 12 is being installed, said braking element 12 is first positioned such that its braking surface 13 is in contact with the draw-off area 11 so that the annular carrier 15 is loosely received in the holder 14. Subsequently, the support ring 16 is inserted until the protrusions 21 abut on the peak contact points 22. Following this, the bearing blocks 6, 7 are pushed onto the holder 4 until the projections 20 engage the recesses 19, and then the fastening elements 18 are tightened.

FIG. 4 shows a braking element 12 with its braking surface 13, the corrugation 14 and the annular carrier 15.

FIG. 5 shows a clear representation of the removed support ring 16 with the two diametrically opposed protrusions 21 on the ring side 23, and the projections 20.

It will be expedient to form the holder 4 integrally with the slide 2 and provide it in the form of a shaped metal part, e.g. a die casting consisting of a light alloy. Also the support ring 16 should be a shaped part consisting of light metal in an expedient manner. The ring side 24 of the annular carrier 15, which should be made of plastic material in an expedient manner, can be flat and, if desired, it can be armored.

In FIGS. 2 and 3, a second Cardan axis B, which is an open Cardan axis, is provided between the support ring 16 and the annular carrier 15. This means that the support ring is not materially connected to the annular carrier via said Cardan axis B but is only coupled under the influence of the biasing force due to the contact of the protrusions 21 with the peak contact points 22 under formation of said second Cardan axis. The two components can be detached from one another at any time and cooperate tiltably about said second Cardan axis under the influence of said biasing force.

In FIG. 6A, it is shown that engagement depressions 25', which are used for receiving therein the protrusions 21' and by means of which a light positive engagement is established, can be arranged in the ring side 24' of the annular carrier 15'.

In FIG. 6B, it can be seen that the ring side 24" has formed thereon a projection 26" with an engagement depression for the protrusion 21", said engagement depression being not shown in detail. In any case, the position of the protrusions 21" and of the peak contact points 22" on the respective rings 15", 16" can be exchanged. In FIG. 6B, the second Cardan axis approaches the first Cardan axis very closely. Notwithstanding this, the projection 26" permits a comparatively large tilting range of the annular carrier 15".

The Cardan holding device K has been explained in detail on the basis of FIGS. 2 to 5 for the annular braking element 12 with a rubber or elastomer membrane and the circumferentially continuous braking surface 13. The structural design of the Cardan holding device K is, however, also expedient in combination with other braking elements with a discontinuous braking surface, which have an appropriate annular carrier 15, this being schematically outlined in FIGS. 1 and 6. In the case of such braking elements, the annular carrier 15 has provided therein resilient plastic or metal lamellae, bristles, teeth or spokes, which abut on the draw-off area 11 of the storage drum P under the influence of the axial biasing force V and which define a circumferentially discontinuous braking surface. Like the annular carrier 15 of the braking element 12 shown, the annular carrier 15 of such a braking element is installed in the Cardan holding device K so as to achieve automatic correct adjustment and centering of the braking surface by means of the two Cardan axes.

I claim:

1. In a yarn braking device comprising a yarn storage drum which defines a circular draw-off area, and an annular braking element which is of an elastic and deformable material and defines a circumferentially continuous braking surface, said braking surface being disposed close to an inner periphery of said braking element, and said braking element being supported on an annular carrier which is disposed proximate an outer periphery of said braking element, said yarn braking device further including a Cardan holding device supported in a stationary manner relative to said storage drum which includes support means for movably supporting said braking element on said Cardan holding device so that said braking element is tiltable about first and second Cardan axes, said first and second Cardan axes extending approximately at right angles to a longitudinal axis of said annular carrier, said Cardan holding device including biasing means for applying an axial biasing force to said braking element which biases said braking element axially toward said storage drum, comprising the improvement wherein said Cardan holding device includes a support ring supported by said support means such that said support ring is tiltable about said first Cardan axis, said support means further comprising a pair of spaced first contact areas on said annular carrier and a pair of spaced second contact areas on said support ring, each of said first contact areas being disposed in opposing contact with one of said second contact areas to define said second Cardan axis, said first and second contact areas being detachable from one another and being pressed axially onto one another by said axial biasing force, said annular carrier and said support ring being in contact with each other only by said first and second contact areas such that said annular carrier is tiltable relative to said support ring about said second Cardan axis.

2. A yarn braking device according to claim 1, wherein said pairs of first and second contact areas are diametrically opposed relative to the longitudinal axis of said support ring, one of said pairs of first and second contact areas being defined by respective peaks of two axially projecting protrusions on a first ring side of one of said support ring and said annular carrier, the other of said pairs of first and second contact areas being defined by two peak contact points on a second ring side of the other of said annular carrier and said support ring.

3. A yarn braking device according to claim 2, wherein each of said peak contact points is defined by a depression formed on said second ring side.

4. A yarn brake device according to claim 2, wherein each of said peak contact points is defined by a projection formed on said second ring side.

5. A yarn braking device according to claim 2, wherein said support ring and said annular carrier are approximately the same size, and said protrusions having a semi-cylindrical shape.

6. A yarn braking device according to claim 2, wherein said second ring side is defined by said annular carrier and faces said support ring, said second ring side being flat so as to define a plurality of said peak contact points and said annular ring including said axial protrusions which are positionable in abutting contact with any of said plurality of said peak contact points.

7. A yarn braking device according to claim 1, wherein said support means of said Cardan holding device comprise two rotary bearings which support said support ring, said rotary bearings defining said first Cardan axis.

8. A yarn braking device according to claim 7, wherein said Cardan holding device comprises an axially displaceable slide disposed proximate said storage drum, an annular holder supported on said displaceable slide so as to move axially therewith, and a pair of diametrically spaced-apart bearing blocks supported on said annular holder, said rotary bearings being interconnected to said bearing blocks so that said support ring is tiltable about said first Cardan axis, said annular holder enclosing said annular carrier from an exterior thereof while permitting radial and axial play therebetween.

9. A yarn braking device according to claim 8, wherein each of said bearing blocks is provided with inner reception means for receiving said annular holder while permitting said radial and axial play, and a fastening element which connects said bearing block to said annular holder, said annular holder being engaged with said inner reception means.

10. A yarn braking device according to to claim 8, wherein each of said bearing blocks is provided with a radially inwardly opening recess and said support ring includes an engagement element on an outer circumference thereof.

11. A yarn braking device according to claim 10, wherein said inwardly opening recess is a radial hole opening radially towards said support ring, and said engagement element is a projection which is rotatably received within said inwardly opening recess so as to define said first Cardan axis and permit tilting of said support ring relative to said bearing blocks.

12. A yarn braking device according to claim 1, wherein said braking surface is frusto-conical.

13. A yarn braking device according to claim 1, wherein said first and second contact areas permit radial displacement of said annular carrier relative to said support ring.

14. A yarn braking device according to claim 1, wherein said first and second contact areas face axially toward each other.

15. A yarn braking device comprising a yarn storage drum which defines a circular draw-off area, and a Cardan holding device supported in a stationary manner proximate said yarn storage drum, said yarn braking device further including an outer annular carrier which includes an inwardly projecting braking element that defines a circumferentially extending braking surface disposed approximately concentric with said annular carrier, said Cardan holding device including support means for movably supporting said annular carrier proximate said storage drum such that said annular carrier is tiltable about first and second Cardan axes extending approximately at right angles relative to an axis of said annular carrier, said storage drum being approximately concentric with said annular carrier, said Cardan holding device further including biasing means for axially biasing said annular carrier toward said storage drum to move said braking surface into contact with said circular draw-off area of said storage drum under the influence of an axial biasing force, comprising the improvement wherein said Cardan holding device includes a support ring which is disposed substantially coaxial with said annular carrier and is fixed in position in said Cardan holding device by said support means so as to be tiltable about said first Cardan axis, said annular carrier being loosely held on said support ring by said support means such that said annular carrier is tiltable relative to said support ring about said second Cardan axis under the influence of said axial biasing force, said second Cardan axis being an open axis such that said support means permits radial movement of said annular carrier relative to said support ring.

16. A yarn braking device according to claim 15, wherein said annular carrier includes first contact surfaces, and said support ring includes second contact surfaces which are disposed in axially opposing relation with said first contact surface, said first and second contact surfaces being in abutting contact with one another and defining said second Cardan axis in an axially fixed position therebetween while permitting said relative radial movement of said annular carrier.

17. A yarn braking device according to claim 16, wherein said first Cardan axis is defined by rotary bearings which support said support ring proximate said storage drum.

18. A yarn braking device according to claim 15, wherein a pair of protrusions project axially between said annular carrier and said support ring to define said second Cardan axis and permit said tilting of said annular carrier relative to said support ring.

19. A yarn storage and feed device comprising a storage drum arranged in stationary manner on a base component and having a circular draw-off area, at least one support bracket secured to said base member and extending along said storage drum in spaced relationship therewith, a slide which is adapted to be displaced in said support bracket parallel to the axis of said storage drum and which carries a Cardan holding device for a yarn braking device, said Cardan holding device defining first and second Cardan axes which intersect each other approximately at right angles, and said yarn braking device comprising a resilient approximately annular braking element with a circumferentially extending braking surface, and an outer annular carrier which supports said braking element such that said braking surface is in an axially biased contact with the draw-off area, comprising the improvement wherein said Cardan holding device includes a support ring which is supported on said slide and is tiltable about said first Cardan axis, said annular carrier of the axially biased braking element being loosely supported on said support ring such that said annular carrier is tiltable about an open second Cardan axis and is displaceable relative to said support ring in a direction transverse to said second Cardan axis.

20. A yarn braking device according to claim 19, wherein said support ring is biased axially into abutting contact with said annular carrier such that said annular carrier is biased axially into contact with said draw-off area of said storage drum, said storage drum preventing axial movement of said annular carrier out of contact with said support ring, said annular carrier being substantially centered on said storage drum in response to said tilting about said first and second Cardan axes and said transverse displacement relative to said support ring.

21. A yarn braking device according to claim 19, which includes protrusions projecting from one of said annular carrier and said support ring into slidable contact with an opposing contact surface on the other of said annular carrier and said support ring, said slidable contact between said protrusions and said contact surface permitting said transverse displacement of said annular carrier.

22. A yarn braking device comprising:

an axially elongate yarn storage drum having a yarn withdrawal end and a yarn storage surface disposed radially outwardly of a longitudinal axis of said storage drum;

a slide support which is slidable axially relative to said storage drum;

a Cardan holding device which is mounted to said slide support and includes a support member disposed proximate said yarn withdrawal end of said storage drum, said support member having first support means for connecting said support member to said slide support, said first support means defining a first Cardan axis oriented transverse to said longitudinal axis to permit tilting of said support member about said first Cardan axis; and a carrier member having brake means which engage said storage drum for braking yarn being withdrawn from said yarn withdrawal end, second support means being provided between said carrier member and said support member for tilting of said carrier member relative to said support member about a second Cardan axis, said second support means permitting radial displacement of said carrier member relative to said support member at least in directions transverse to said first and second Cardan axes, said brake means being positioned in engagement with said storage drum by axial sliding of said slide support.

23. A yarn braking device according to claim 22, wherein said carrier member is annular and disposed substantially coaxial with said storage drum.

24. A yarn braking device according to claim 23, wherein said second support means comprise an annular contact face on said carrier member which faces axially toward said support member and at least two projections on said support member which project axially into contact with said contact face.

25. A yarn braking device according to claim 24, wherein said contact face includes flat contact surfaces disposed in contact with said projections.

26. A yarn braking device according to claim 24, wherein said contact face includes at least two depressions which pivotally seat said projections respectively therein.

27. A yarn braking device according to claim 22, which includes protrusions projecting from one of said carrier member and said support member into slidable contact with an opposing contact surface on the other of said carrier member and said support member, said slidable contact between said protrusions and said contact surface permitting said radial displacement of said carrier member.

* * * * *